US007490622B2

(12) United States Patent
Jones

(10) Patent No.: US 7,490,622 B2
(45) Date of Patent: Feb. 17, 2009

(54) ROTATABLE QUICK EXHAUST VALVE

(75) Inventor: Danial Jones, Loyalhanna, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 167 days.

(21) Appl. No.: 11/449,977

(22) Filed: Jun. 9, 2006

(65) Prior Publication Data

US 2006/0278270 A1 Dec. 14, 2006

Related U.S. Application Data

(60) Provisional application No. 60/689,371, filed on Jun. 10, 2005.

(51) Int. Cl.
*F16K 11/00* (2006.01)

(52) U.S. Cl. ..... 137/102; 285/272

(58) Field of Classification Search ..... 137/102, 137/580, 375; 285/272; 251/148, 151
See application file for complete search history.

(56) References Cited

U.S. PATENT DOCUMENTS 4,946,204 A * 8/1990 Boticki ..... 285/281
5,279,322 A * 1/1994 Nakamura et al. ..... 137/102
5,533,764 A * 7/1996 Williamson ..... 285/212
6,089,225 A * 7/2000 Brown et al. ..... 128/200.29
6,637,454 B1 * 10/2003 Eley ..... 137/355.26
2005/0022816 A1 * 2/2005 Krawczyk et al. ..... 128/204.26
2006/0157131 A1 * 7/2006 Harris et al. ..... 137/889

* cited by examiner

*Primary Examiner*—Stephen M Hepperle
*Assistant Examiner*—William McCalister
(74) *Attorney, Agent, or Firm*—Simple IP Law, P.C.; Craig R. Rogers

(57) ABSTRACT

A quick exhaust valve is preferably constructed having a port connector, an input body, and an exhaust body. The input body and exhaust body are preferably arranged in a rotatable relationship with the port connector such that an input port of the input body can be arranged in a desired orientation with respect to a connected device and still permit communication between ports in the input and exhaust bodies and a port in the port connector.

12 Claims, 14 Drawing Sheets

ROTATABLE QUICK EXHAUST VALVE

PRIORITY CLAIM

This application is related to and claims priority from U.S. Provisional Patent Application Ser. No. 60/689,371, filed Jun. 10, 2005, the contents of which are incorporated herein by reference in their entirety.

BACKGROUND OF THE INVENTION

This invention relates generally to quick exhaust valves or (QEVs). More specifically, this invention relates primarily to a quick exhaust valve for rapidly releasing compressed gas from a compressed gas area in communication with a piston in a paintball gun.

Quick exhaust valves have been used in connection with ram assemblies on Auto Cocker and Intimidator paintball guns, for instance, to reduce a ram cycle time by increasing the speed with which compressed gas is released from contact with an end of a pneumatic piston (or ram). Unfortunately, however, conventional QEV's have not been able to swivel (or rotate) about an axis, and their orientation has therefore been dependent on their threaded relationship with a connected device.

Accordingly, it would be desirable to have a quick exhaust valve that was capable of being oriented in a desired position regardless of its orientation with a connected device created by its threaded engagement thereto.

SUMMARY OF THE INVENTION

According to a preferred embodiment of the present invention, a quick exhaust valve is configured to enable it to swivel or rotate about an axis in order to facilitate various desired orientations with the paintball gun, regardless of the orientation created by its engagement with a connected device. In one embodiment, a body of the quick exhaust valve is able to rotate with respect to a connection portion of the quick exhaust valve. In one such embodiment, the rotation can, for instance, be up to 360 degrees.

BRIEF DESCRIPTION OF THE DRAWINGS

The foregoing and other features and advantages of the invention will become more readily apparent from the following detailed description of a preferred embodiment of the invention which proceeds with reference to the accompanying drawings, in which.

DETAILED DESCRIPTION

The principles of the present invention will be described more fully hereinafter with reference to particular embodiments thereof. It should be recognized, however, that the invention may be embodied in many different forms and need not include every feature of the described embodiments. The invention should therefore not be construed as being limited to any one or more of the embodiments set forth herein, nor as requiring the specific features or a specific combination of features of these embodiments, except as may be expressly recited in the claims.

Figure 1:
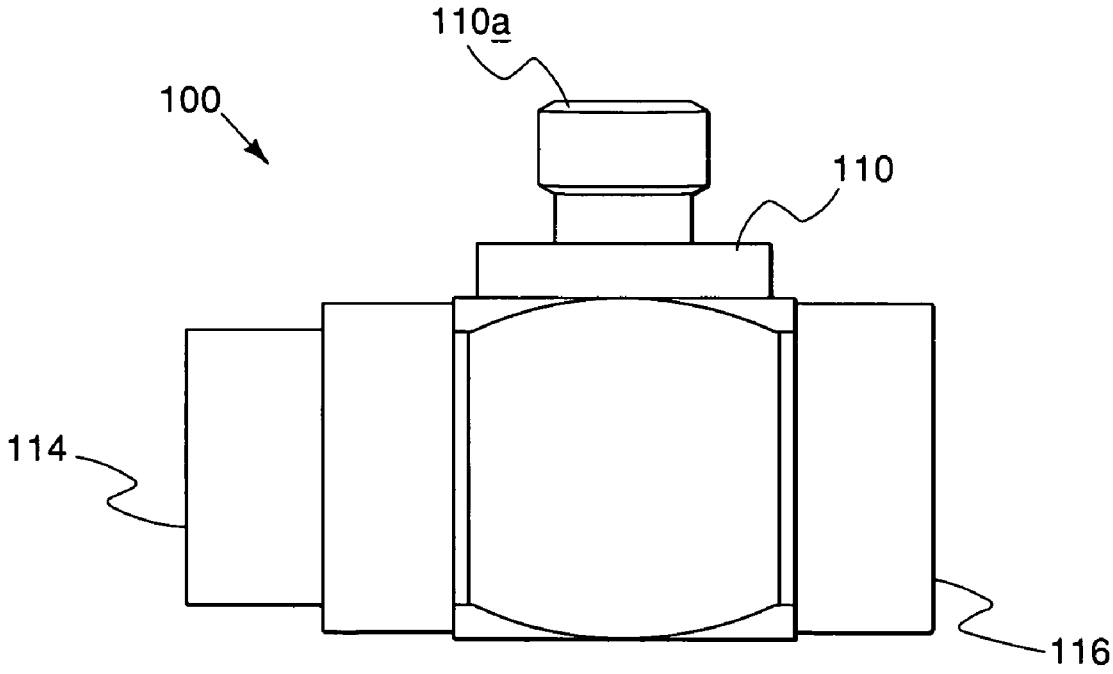
FIG. 1 (BACKGROUND ART)
FIG. 1 is a somewhat schematic side view of a conventional quick exhaust valve.
Figure 2:
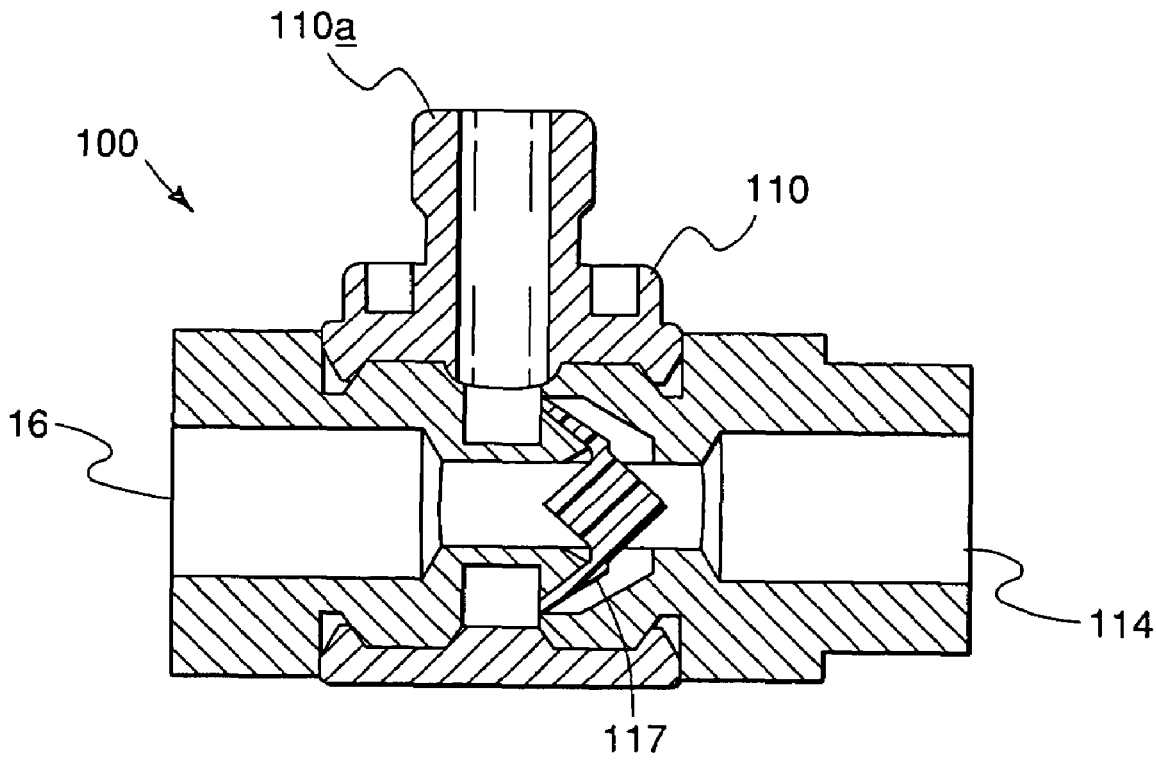
FIG. 2 (BACKGROUND ART)
FIG. 2 is a somewhat schematic cross-sectional side view of the conventional quick exhaust valve of FIG. 1.
Figure 3:
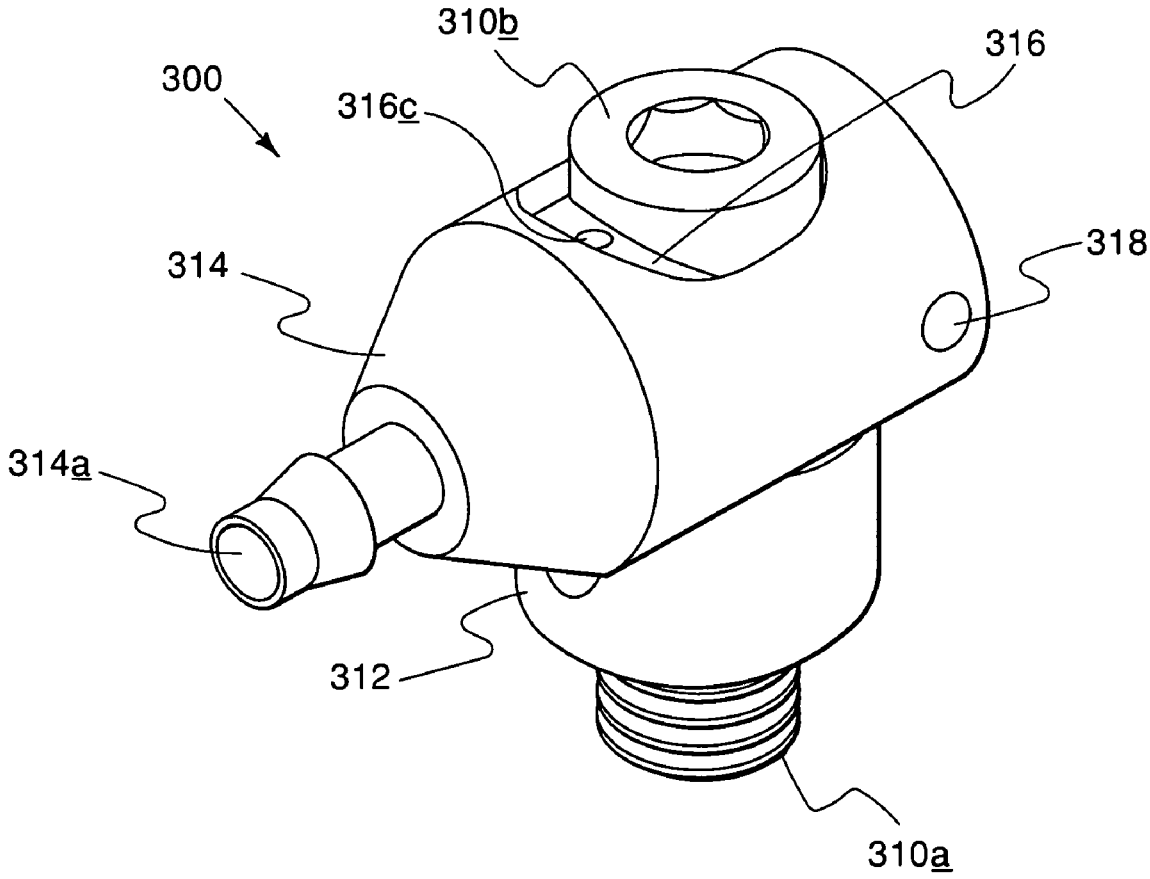
FIG. 3 is a somewhat schematic perspective view of a rotatable quick exhaust valve according to a preferred embodiment of the present invention.
Figure 4:
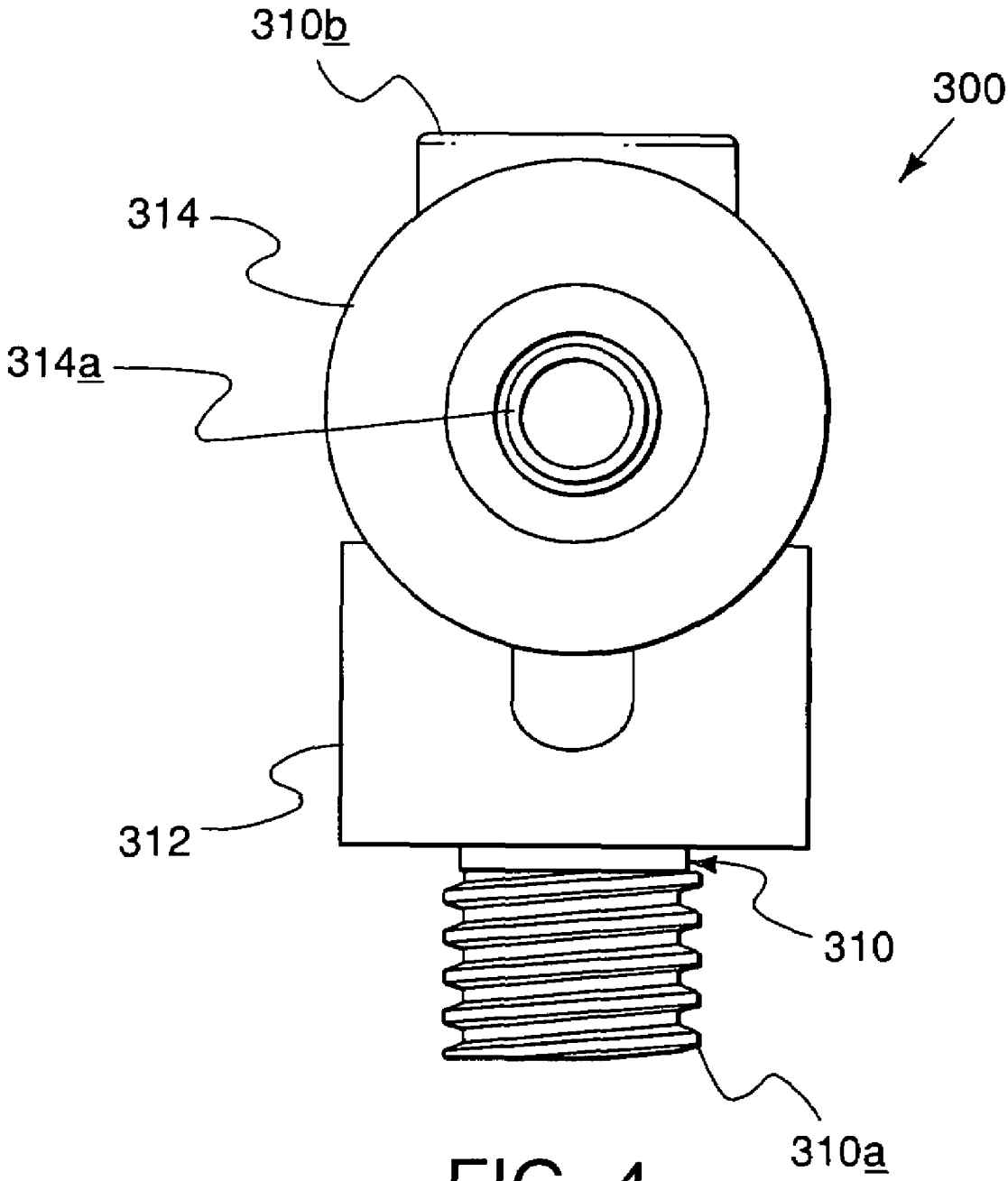
FIG. 4 is a somewhat schematic front elevation view of the rotatable quick exhaust valve of FIG. 3.
Figure 5:
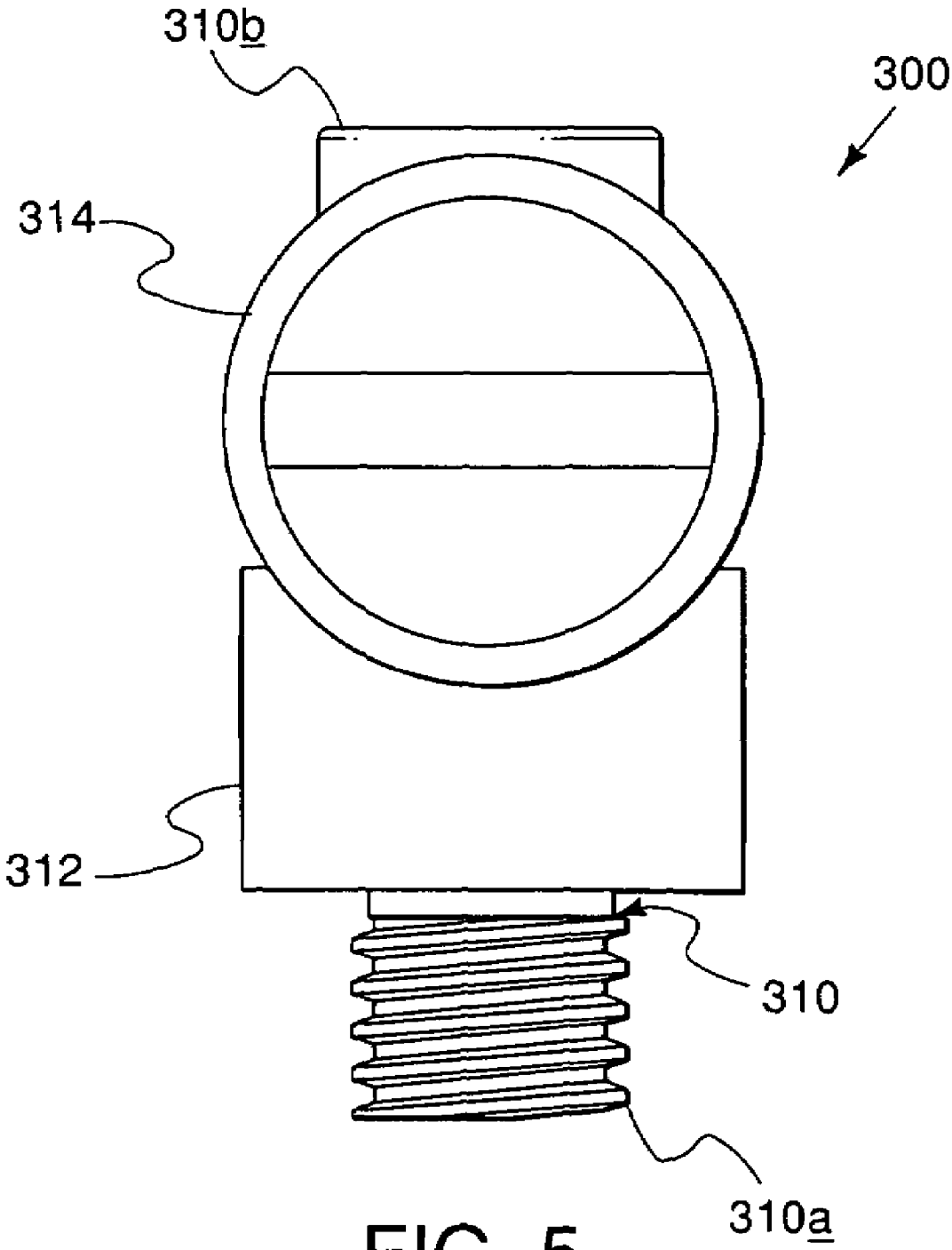
FIG. 5 is a somewhat schematic rear elevation view of the rotatable quick exhaust valve of FIG. 3.
Figure 6:
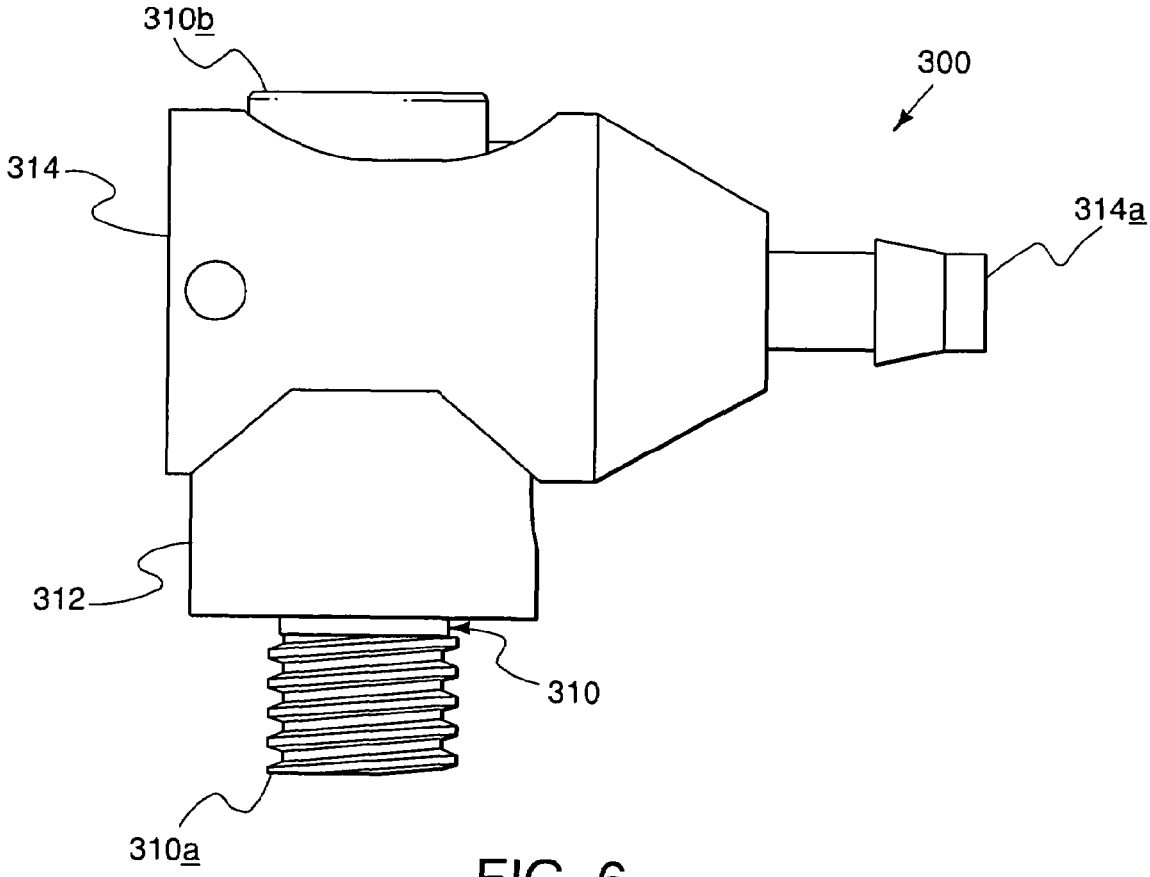
FIG. 6 is a somewhat schematic left side elevation view of the rotatable quick exhaust valve of FIG. 3.
Figure 7:
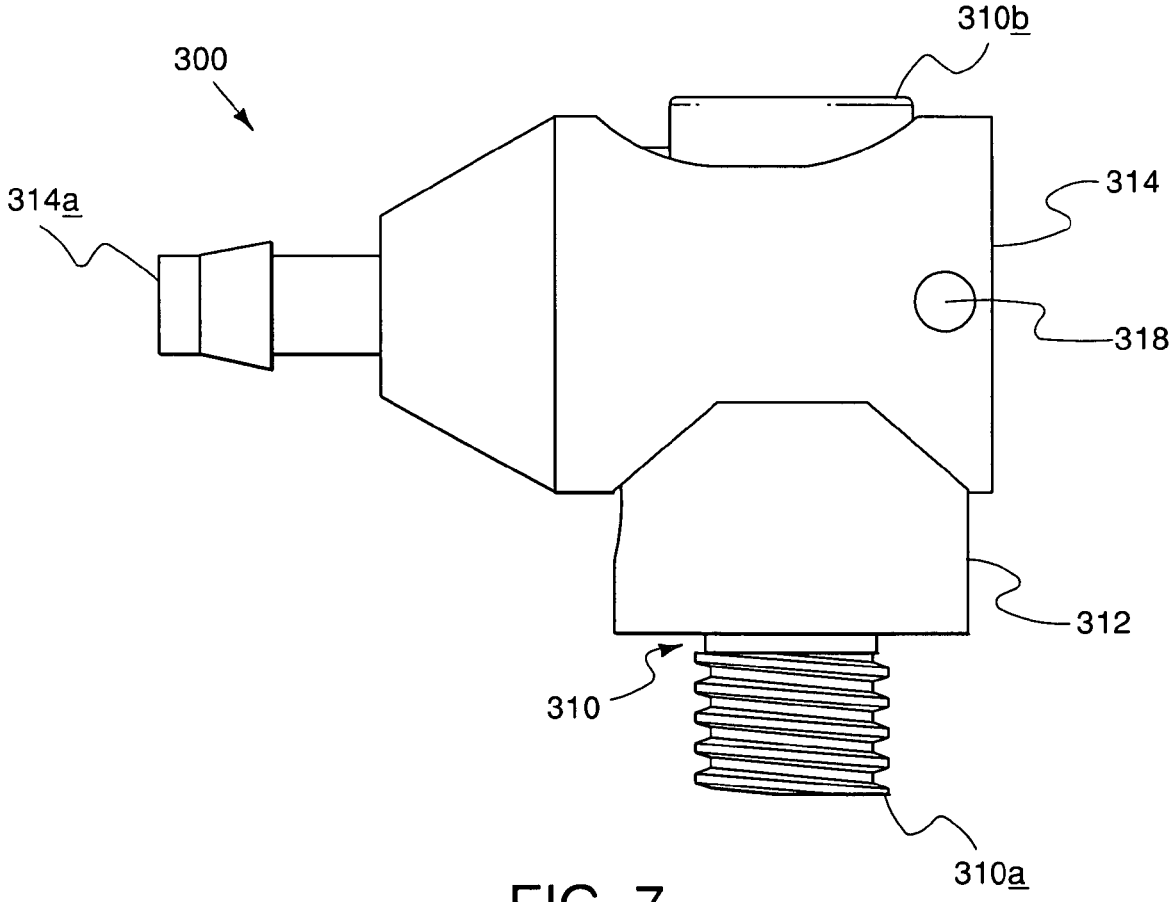
FIG. 7 is a somewhat schematic right side elevation view of the rotatable quick exhaust valve of FIG. 3.
Figure 8:
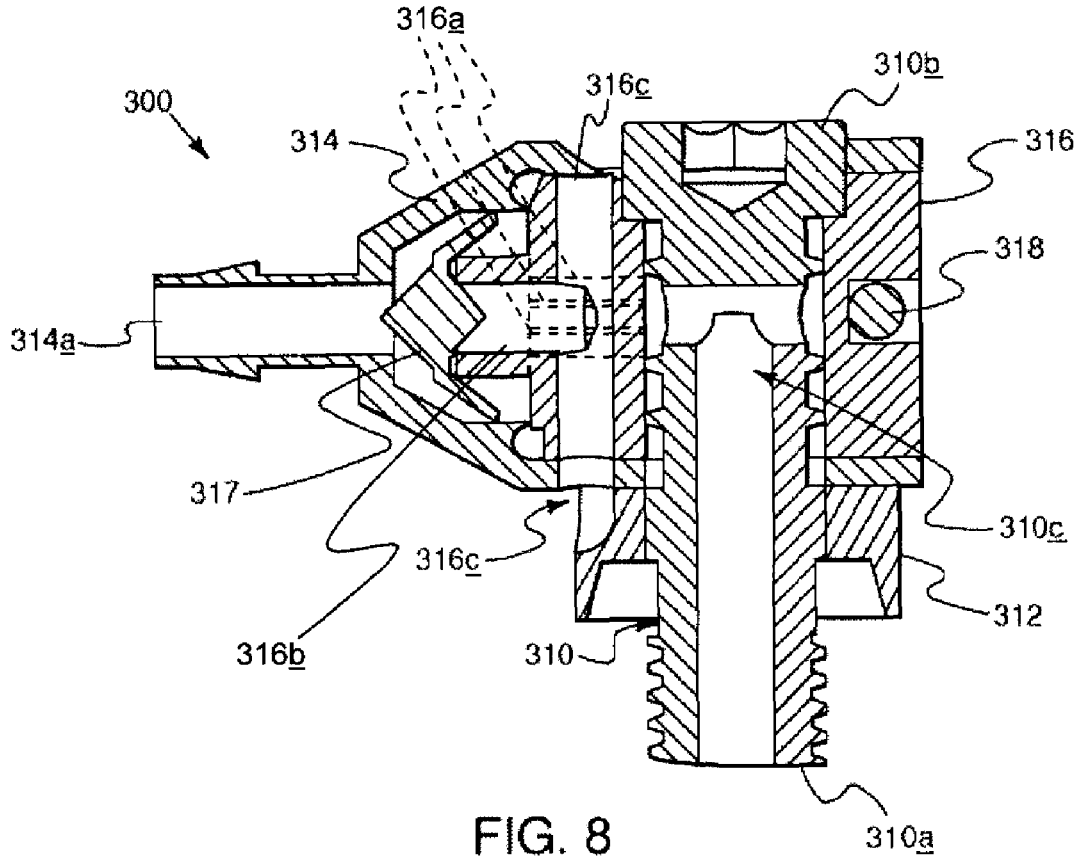
FIG. 8 is a somewhat schematic right side cross-sectional view of the rotatable quick exhaust valve of FIG. 3.
Figure 9:
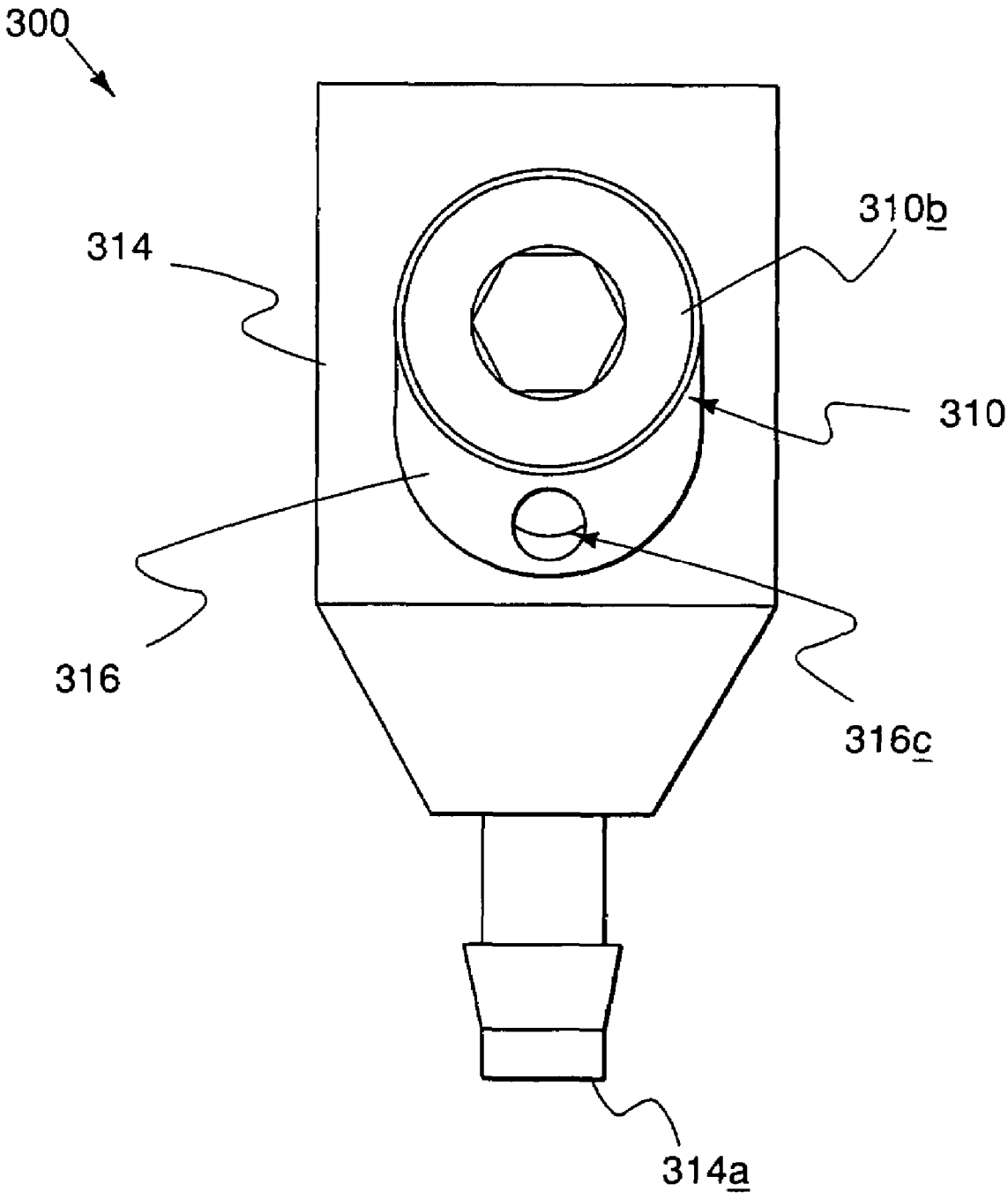
FIG. 9 is a somewhat schematic top plan view of the rotatable quick exhaust valve of FIG. 3.
Figure 10:
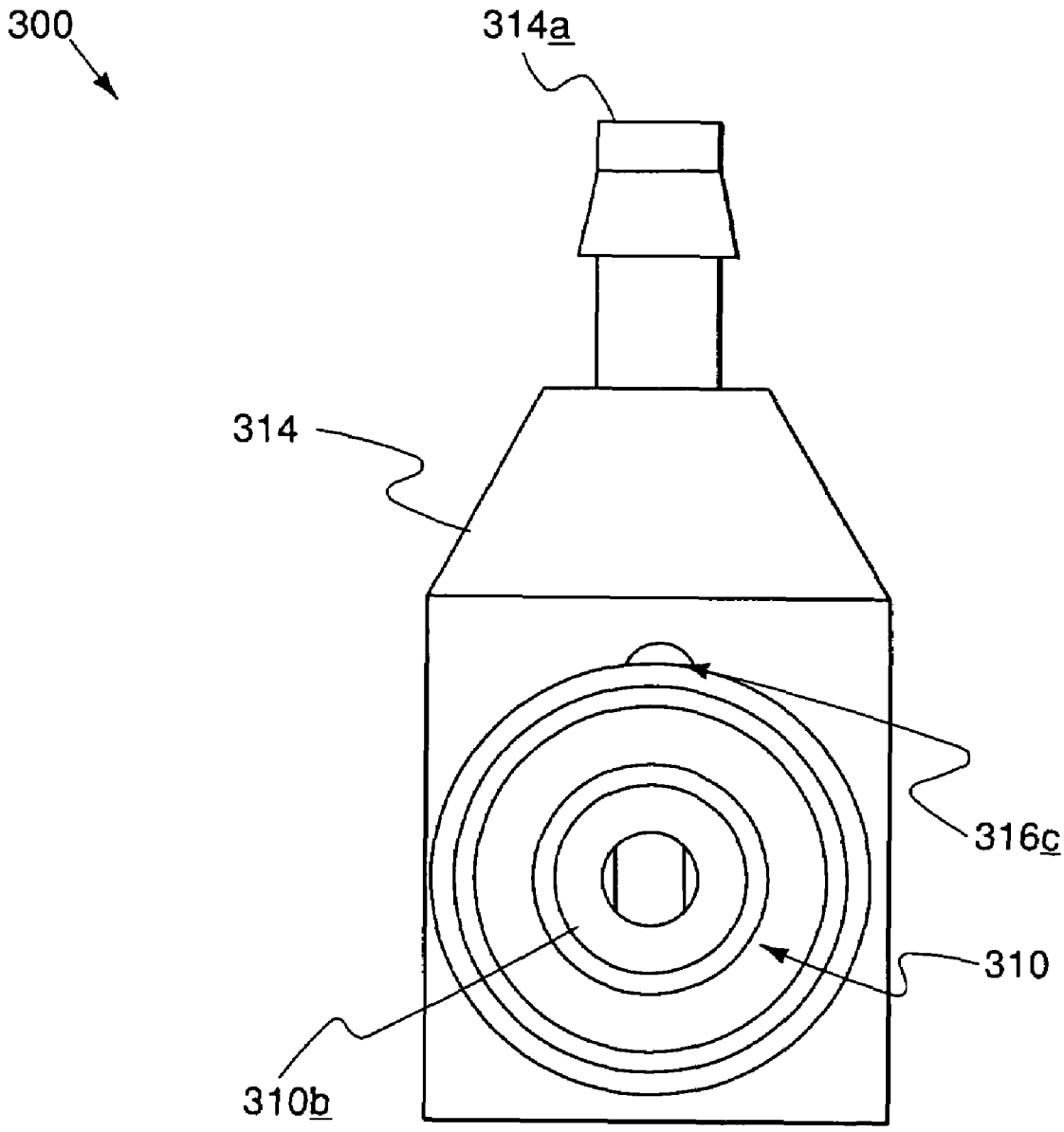
FIG. 10 is a somewhat schematic bottom plan view of the rotatable quick exhaust valve of FIG. 3.
Figure 11:
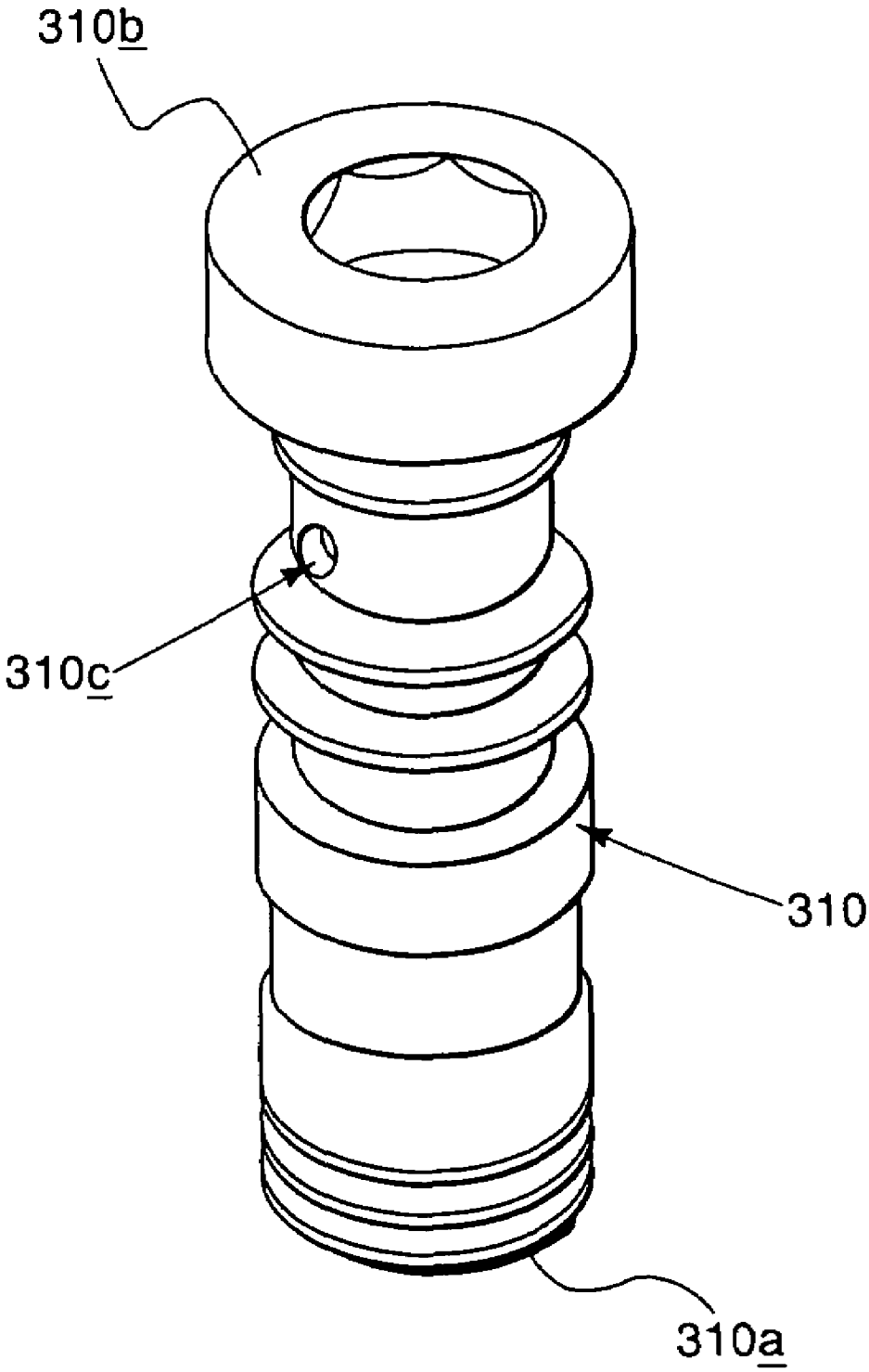
FIG. 11 is a somewhat schematic perspective view of a port connector of the rotatable quick exhaust valve of FIG. 3.
Figure 12:
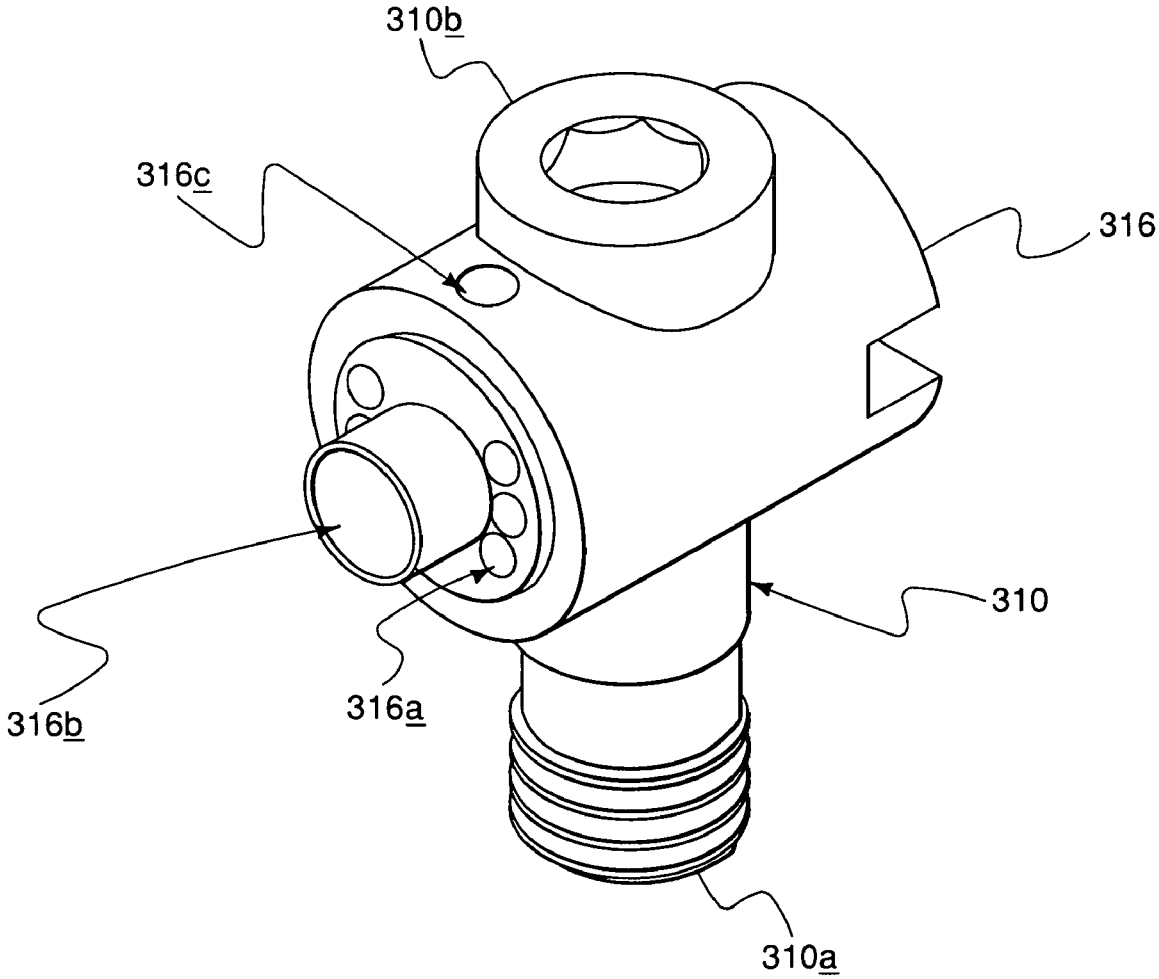
FIG. 12 is a somewhat schematic perspective view of the port connector and an exhaust body of the rotatable quick exhaust valve of FIG. 3.
Figure 13:
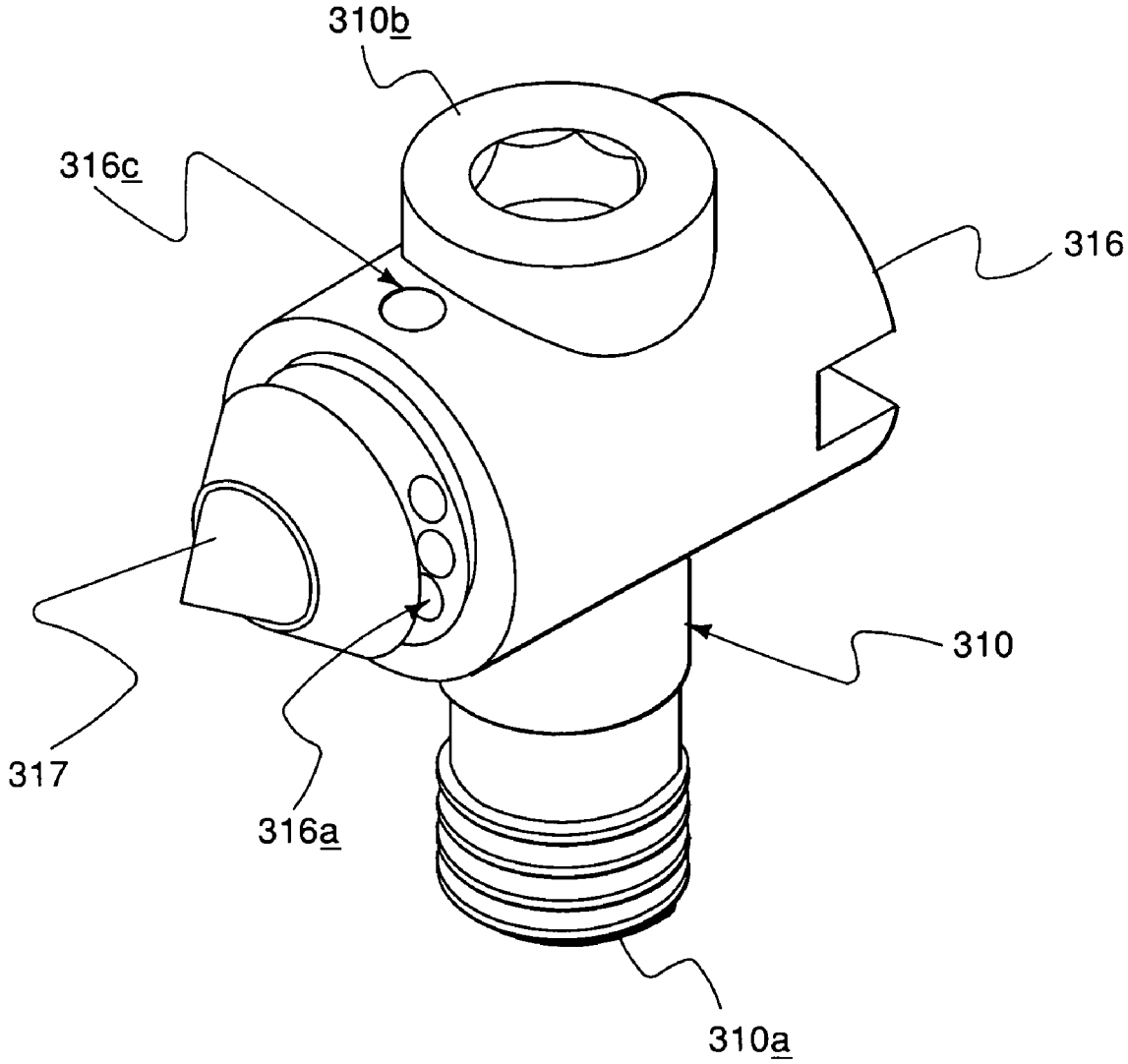
FIG. 13 is a somewhat schematic perspective view of the port connector, exhaust body, and a valve member of the rotatable quick exhaust valve of FIG. 3.
Figure 14:
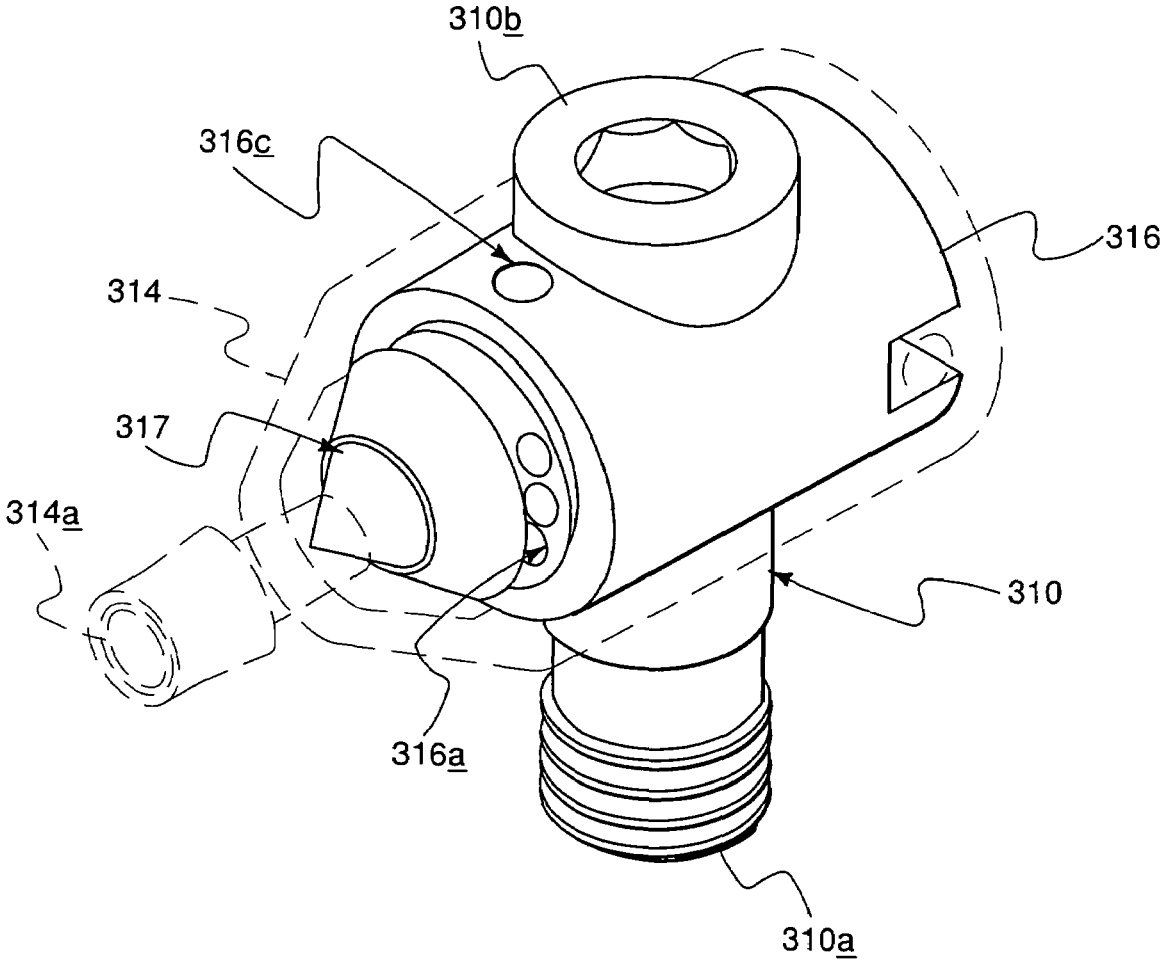
FIG. 14 is a somewhat schematic perspective view of the rotatable quick exhaust valve of FIG. 3 showing an input housing transparently to permit viewing of relationships of internal components.

FIGS. 1 and 2 are side and cross-sectional views, respectively, illustrating a conventional quick exhaust valve (or QEV) 100. Referring to FIGS. 1 and 2, a conventional QEV 100 includes an input port 114, an exhaust port 116, and a connector port 110. Input into the QEV 100 from a compressed gas source (not shown) enters through the input port 114 and is fed around the collapsible one-way valve 117 to the connector port 110. During this operation, the valve 117 seals the exhaust port 116 and prevents compressed gas from escaping to atmosphere. When compressed gas is exhausted from a connected device (not shown) through the connector port 110, the compressed gas from the connector port 110 shifts the one-way valve 117 toward the inlet port 114. This operation opens the exhaust port 116 to atmosphere, rapidly discharging the compressed gas from the connected device through the connector port 110 and exhaust port 116. Unfortunately, the connector port 110 is arranged in a fixed relationship with the input port 114 and exhaust port 116 and does not permit rotation of the input or output ports 114, 116 with respect to the connector port 110.

FIGS. 3-14 illustrate a rotatable quick exhaust valve 300 according to a preferred embodiment of the present invention. Referring to FIGS. 3-14, a rotatable quick exhaust valve 300 according to a preferred embodiment includes a port connector 310 preferably having a threaded end 310*a* and an opposite retaining end 310*b*. An input housing 314 is preferably arranged near the retaining end 310*b*. An exhaust body 316 and valve member 317 are arranged in the input housing 314 and held in place using a locking pin 318. A spacer 312 is preferably arranged on the port connector 310 between the input housing 314 and the threaded end 310*a* to maintain an appropriate distance between the input housing 314 and a housing of a device (not shown) to which the quick exhaust valve 300 is connected.

Compressed gas supplied to the input port 314*a* is directed past the collapsible valve 317 into the porting 310*c* in the port connector 310 via radial ports 316*a* in the exhaust body 316. The compressed gas also forces the valve 317 toward exhaust valve 316*b* to prevent the compressed gas from escaping through the exhaust ports 316*b*, 316*c*. In this manner, compressed gas can be supplied to a connected device.

Compressed gas to be released from the connected device is transmitted through the porting 310*c* and through the radial ports 316*a* into contact with the valve 317. When compressed gas on the input side is vented, the compressed gas to be exhausted forces the valve 317 toward the input port 314*a*, opening exhaust port 316*b*. The compressed gas then exits through exhaust ports 316*b* and 316*c*.

According to one aspect of this invention, the input housing 314 and exhaust body 316 can be arranged on the port connector 310 such that they are capable of rotating about an axis, such as the axis defined by a longitudinal axis of the port connector 310. Porting 310*c* in the port connector 310 is preferably configured to be capable of fluid communication with the input housing 314 and exhaust body 316 regardless of the orientation of the input housing 314 and exhaust body 316 with respect to the port connector 310.

In this manner, according to the preferred embodiment, the input port 314*a* can be arranged in any desired orientation in a 360 degree circle defined around a rotational axis and can therefore also be optimally positioned with respect to the connected device (not shown). Of course, different degrees of rotation can also be provided. This facilitates a much easier connection between a compressed gas supply and the input port 314*a* and also improves tolerance requirements by eliminating the need to orient the QEV 300 with the connected device solely via its threaded engagement.

Having described and illustrated the principles of the invention, it should be apparent that the invention can be modified in arrangement and detail without departing from such principles. Accordingly, the invention should be construed to cover all modifications and variations coming within the spirit and scope of the following claims.

What is claimed is:

1. A quick exhaust valve comprising:

a port connector having a threaded connection end configured to be attached to a pneumatic port;

a valve housing arranged on the port connector such that a body of the port connector extends through the valve housing from one side of the valve housing to an opposite side of the valve housing, and wherein said valve housing is capable of rotating with respect to the port connector, said valve housing having an input port configured to receive compressed gas from a compressed gas supply;

an exhaust arranged in the valve housing and having an exhaust port communicating with an exterior of the quick exhaust valve;

a valve member arranged in the valve housing, wherein said valve member is configured to direct compressed gas from the input port to the pneumatic port when compressed gas is supplied to the input port, wherein said valve member vents compressed gas from the pneumatic port through the exhaust port when the input port is vented, and wherein the exhaust comprises a body comprising a plurality of ports surrounding the exhaust port in a circular pattern. wherein the plurality of ports are configured to transmit compressed gas to an attached device through the port connector when compressed gas is supplied to the input port of the valve housing.

2. A valve according to claim 1, wherein the port connector comprises a longitudinal axis and wherein the valve housing is rotatable about the longitudinal axis of the port connector.

3. A valve according to claim 2, wherein the valve housing is capable of 360 degrees of rotation about the longitudinal axis of the port connector.

4. A valve according to claim 1, further comprising a separately formed spacer arranged on the port connector between a connection end and the valve housing to space the valve housing apart from a connection between the port connector and the attached device.

5. A valve according to claim 1, wherein the input port communicates with a piston cylinder.

6. A valve according to claim 1, wherein the plurality of ports are configured to receive compressed gas from the attached device through the port connector and provide it to the exhaust port when the compressed gas supply to the input port of the valve housing is vented.

7. A valve according to claim 1, wherein the port connector comprises a tranverse port disposed through a width of the port connector body, and further comprises a longitudinal port disposed through the port connector body from an output port to the transverse port.

8. A valve according to claim 1, further comprising a locking pin for retaining the exhaust body within the valve housing.

9. A valve according to claim 1, wherein the exhaust comprises a body rotatably surrounding the port connector, with the body of the port connector extending through the exhaust body from one side of the exhaust body to an opposite side thereof, and wherein the valve member is arranged in the valve housing between the input port and the exhaust body.

10. quick exhaust valve, comprising:

a connector configured to attach to a pneumatic device at a connection end, said connector having a substantially cylindrical body and having a port arranged through an internal portion of the body and extending from an opening in the connection end toward a transverse port arranged near an opposing end;

an exhaust body surrounding a portion of the connector body, where the connector body extends through the exhaust body, and wherein said exhaust body comprises one or more ports arranged in fluid communication with the connector port, said exhaust body further comprising an exhaust port arranged in fluid communication with an exterior of the quick exhaust valve;

a valve housing configured to house the exhaust body, wherein the connector body extends through a width of the valve housing, and wherein said valve housing and said exhaust body are arranged in a rotatable relationship with respect to the connector body;

a locking pin disposed through holes in opposing sides of the valve housing and through a slot arranged on a rearward end of the exhaust body to lock the valve housing and exhaust body onto the connector body; and a valve member arranged in the valve housing between an inlet port of the valve housing and the exhaust port of the exhaust body, wherein the valve member is configured to permit flow between the inlet port and a connector port when compressed gas is supplied to the inlet port and to vent compressed gas from the connector port through the exhaust port when the inlet port is vented.

11. A valve according to claim 10, wherein the valve housing and exhaust body are configured to rotate about a longitudinal axis of the connector body.

12. A valve according to claim 10, further comprising a spacer arranged on a portion of the connector body between the connection end and the valve housing to maintain the valve housing a predetermined distance from a connection point between the valve and the connected pneumatic device, wherein the spacer comprises a slot arranged in communication with the exhaust port to exhaust compressed gas from the valve.

* * * * *